US007649131B1

(12) United States Patent
Yu

(10) Patent No.: US 7,649,131 B1
(45) Date of Patent: Jan. 19, 2010

(54) WIND INSTRUMENT STAND

(76) Inventor: Tsung-Yao Yu, 93, Sec. 3, Minsheng Rd., Daya Township, Taichung County (TW)

( * ) Notice: Subject to any disclaimer, the term of this patent is extended or adjusted under 35 U.S.C. 154(b) by 0 days.

(21) Appl. No.: 12/372,073

(22) Filed: Feb. 17, 2009

(51) Int. Cl.
*G10D 7/10* (2006.01)

(52) U.S. Cl. ..... 84/387 A

(58) Field of Classification Search ..... 84/421, 84/327, 329; 248/443; 206/314
See application file for complete search history.

(56) References Cited

U.S. PATENT DOCUMENTS 5,121,890 A * 6/1992 Komada ..... 248/122.1
7,087,826 B1 * 8/2006 Lombardi ..... 84/421

* cited by examiner

*Primary Examiner*—Kimberly R Lockett
(74) *Attorney, Agent, or Firm*—Alan Kamrath; Kamrath & Associates PA

(57) ABSTRACT

A wind instrument stand includes a base and a holding unit. The base includes a front support frame and a rear support frame. The holding unit includes a support rod rotatably mounted on the front support frame, two holding members pivotally mounted on the support rod respectively, and two torsion springs each biased between the support rod and the respective holding member. Thus, when the neck of the saxophone is placed between the holding members, the holding members are pivoted and moved toward each other by the weight of the saxophone to clamp the neck of the saxophone, so that the neck of the saxophone is clamped between the holding members exactly and stably to prevent the saxophone from being detached from the holding members due to an accidental vibration or hit.

17 Claims, 17 Drawing Sheets

WIND INSTRUMENT STAND

BACKGROUND OF THE INVENTION

1. Field of the Invention

The present invention relates to a musical instrument stand and, more particularly, to a wind instrument stand for supporting a wind instrument, such as a saxophone, clarinet, horn, flute and the like.

2. Description of the Related Art

A conventional wind instrument stand 1 in accordance with the prior art shown in FIG. 17 comprises a base 12 having a support seat 120 and three support legs 121 pivotally mounted on the support seat 120, an upright post 11 having a lower end mounted on the support seat 120 of the base 12, a bracket 15 mounted on the upper end of the upright post 11 to support the neck of a saxophone (not shown), two rods 14 mounted on the mediate portion of the upright post 11 to support the bottom of the saxophone, and a pole unit 13 mounted on one of the support legs 121 of the base 12 to support a clarinet and having a pole 131 and a bell 132. However, the saxophone is loosely supported by the bracket 15 and the two rods 14, so that the saxophone is easily detached from the bracket 15 and the two rods 14 due to an accidental vibration or hit and falls down onto the ground. In addition, each of the support legs 121 of the base 12 is disposed at an inclined state, so that the pole unit 13 is also disposed at an inclined state. Thus, the pole unit 13 cannot support the clarinet smoothly ands stably.

BRIEF SUMMARY OF THE INVENTION

In accordance with the present invention, there is provided a wind instrument stand, comprising a base and a holding unit. The base includes a front support frame, and a rear support frame pivotally connected with the front support frame. The holding unit is mounted on the front support frame of the base and includes a support rod rotatably mounted on a top of the front support frame, two holding members pivotally mounted on two opposite ends of the support rod respectively, and two torsion springs each biased between the support rod and a respective one of the two holding members.

The primary objective of the present invention is to provide a wind instrument stand, wherein when the neck of the saxophone is placed between the two holding members of the holding unit, the two holding members of the holding unit are pivoted and moved toward each other by the weight of the saxophone to reach the holding position so as to hold and clamp the neck of the saxophone, so that the neck of the saxophone is clamped between the two holding members of the holding unit exactly and stably so as to prevent the saxophone from being detached from the two holding members of the holding unit due to an accidental vibration or hit.

Another objective of the present invention is to provide a wind instrument stand, wherein when the neck of the saxophone is detached from the two holding members of the holding unit, the two holding members of the holding unit are pivoted to space from each other by the restoring force of each of the two torsion springs to reach the expanding position, so that the neck of the saxophone can be easily removed from the two holding members of the holding unit.

A further objective of the present invention is to provide a wind instrument stand, wherein each of the two front legs of the front support frame has a distal end that is arranged at a horizontal state, so that each of the first pole unit and the second pole unit is vertical to the ground so as to support the clarinets smoothly and stably.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
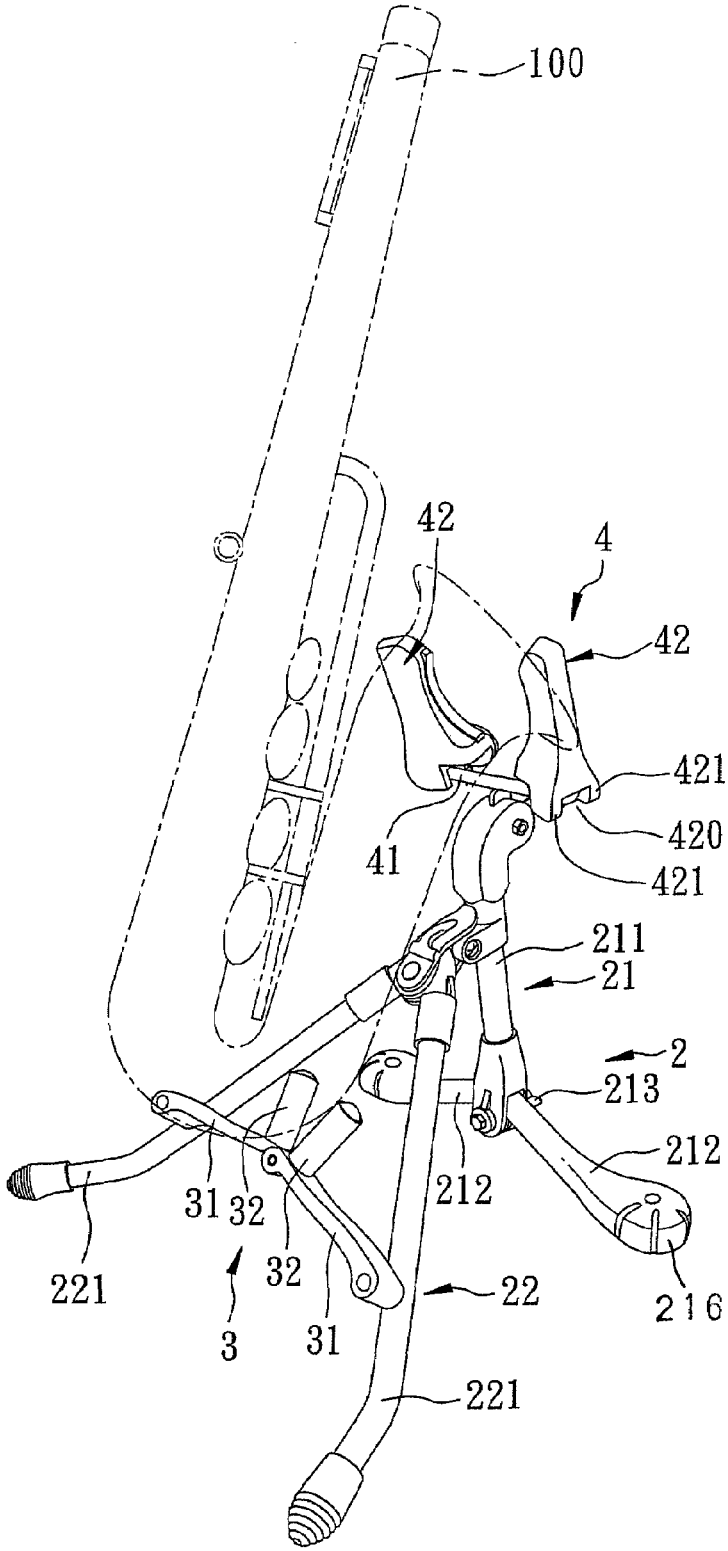
FIG. 1 is a perspective view of a wind instrument stand in accordance with the preferred embodiment of the present invention.
Figure 2:
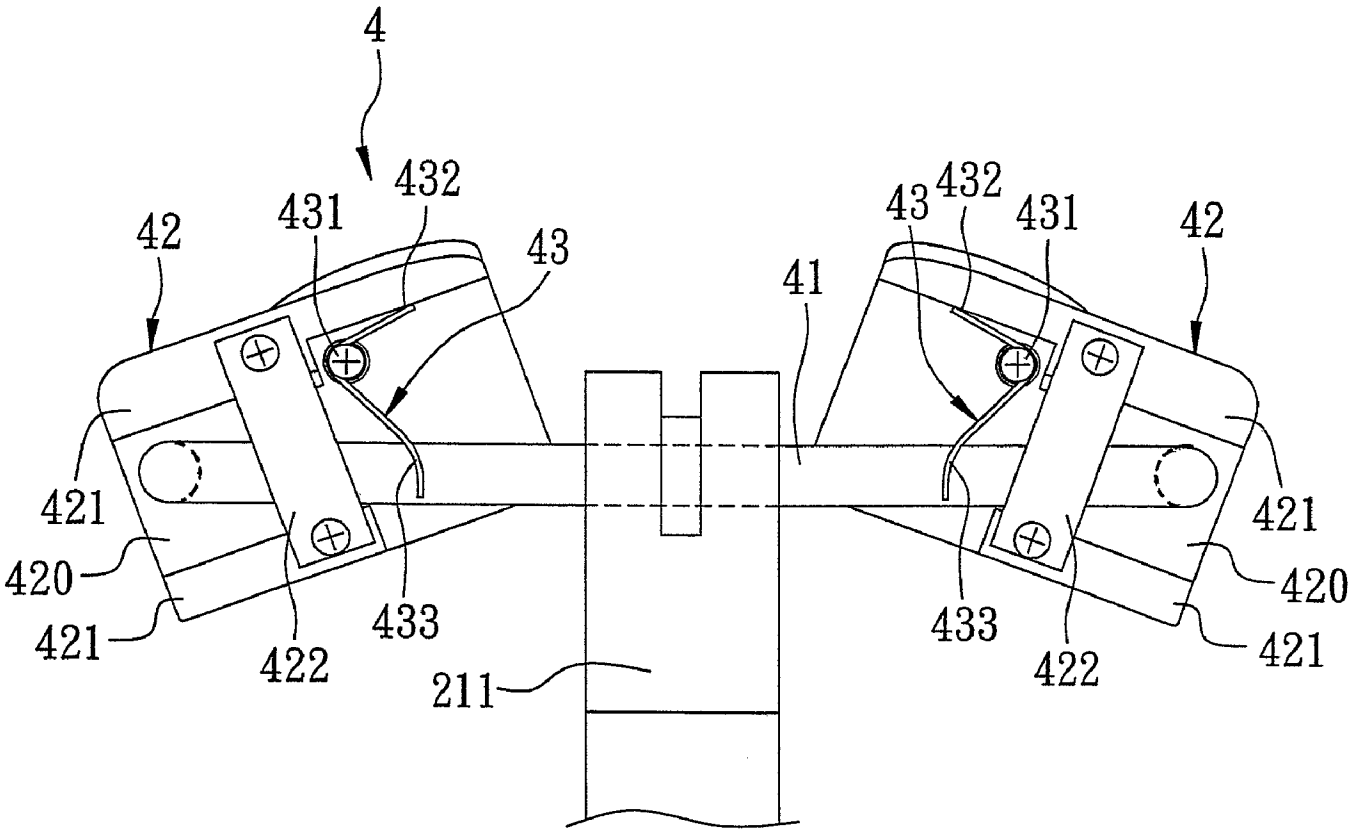
FIG. 2 is a partially bottom view of the wind instrument stand as shown in FIG. 1.
Figure 3:
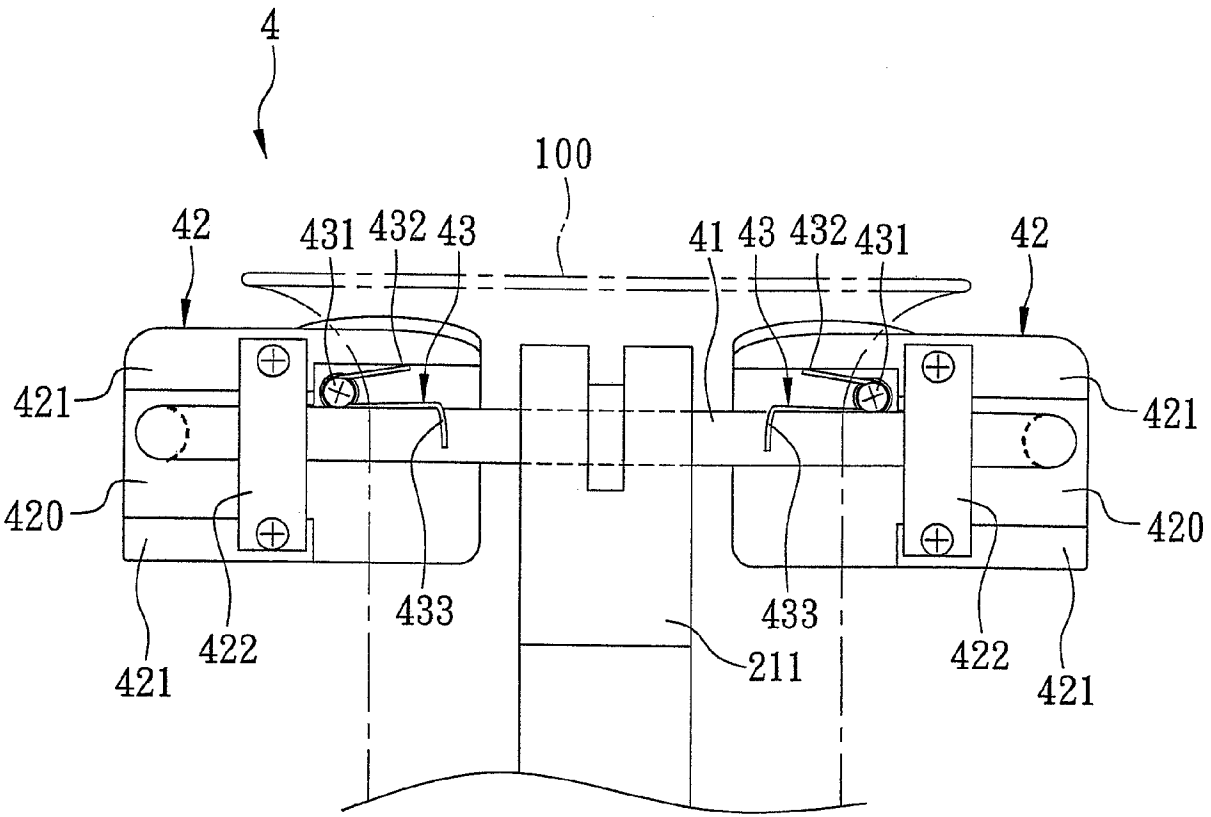
FIG. 3 is a schematic operational view of the wind instrument stand as shown in FIG. 2.

Referring to the drawings and initially to FIGS. 1-3, a wind instrument stand in accordance with the preferred embodiment of the present invention comprises a base 2, a support unit 3 and a holding unit 4.

The base 2 includes a front support frame 21 and a rear support frame 22 pivotally connected with the front support frame 21. The rear support frame 22 of the base 2 extends rearward from a top of the front support frame 21. The rear support frame 22 of the base 2 co-operates with the front support frame 21 of the base 2 to form a standing state. The front support frame 21 of the base 2 includes an upright main body 211 and two front legs 212 each pivotally connected with a bottom of the main body 211. Each of the two front legs 212 of the front support frame 21 extends outward from the bottom of the main body 211 and has a distal end 216 that is arranged at a horizontal state. The rear support frame 22 of the base 2 includes two rear legs 221 each pivotally connected with a top of the main body 211 of the front support frame 21. Each of the two rear legs 221 of the rear support frame 22 extends rearward from the top of the main body 211 of the front support frame 21. The two rear legs 221 of the rear support frame 22 co-operate with the two front legs 212 of the front support frame 21 to form a standing state.

The support unit 3 is mounted on the rear support frame 22 of the base 2 and includes two support members 31 pivotally connected with each other and each pivotally connected with a respective one of the two rear legs 221 of the rear support frame 22 and two support posts 32 mounted on the two support members 31 respectively.

The holding unit 4 is mounted on the front support frame 21 of the base 2 and includes a support rod 41 rotatably mounted on a top of the front support frame 21, two holding members 42 pivotally mounted on two opposite ends of the support rod 41 respectively, and two torsion springs 43 each biased between the support rod 41 and a respective one of the two holding members 42.

A wind instrument, such as a saxophone 100, is mounted between the support unit 3 and the holding unit 4. The saxophone 100 has a bottom placed on and supported by the support unit 3 and a neck placed on and supported by the holding unit 4. The bottom of the saxophone 100 is placed between the two support posts 32 of the support unit 3, and the neck of the saxophone 100 is placed between the two holding members 42 of the holding unit 4. Each of the two holding members 42 of the holding unit 4 has a side provided with an arcuate face to support the neck of the saxophone 100.

The two holding members 42 of the holding unit 4 are movable relative to the support rod 41 of the holding unit 4 between an expanding position as shown in FIG. 2 and a holding position as shown in FIG. 3. The two holding members 42 of the holding unit 4 are pivoted to space from each other to reach the expanding position. At this time, when the neck of the saxophone 100 is placed between the two holding members 42 of the holding unit 4, the two holding members 42 of the holding unit 4 are rotated inward and moved toward each other by the weight of the saxophone 100. Thus, the two holding members 42 of the holding unit 4 are pivoted and moved toward each other to reach the holding position so as to hold and clamp the neck of the saxophone 100.

Each of the two holding members 42 of the holding unit 4 has a bottom provided with two downward extending extension walls 421 and a passage 420 defined between the two extension walls 421. The holding unit 4 further includes two stop plates 422 mounted between the two extension walls 421 of a respective one of the two holding members 42 and facing the passage 420 of the respective holding member 42. Each of the two opposite ends of the support rod 41 extends through the passage 420 of a respective one of the two holding members 42 and is limited by a respective one of the two stop plates 422.

Each of the two torsion springs 43 of the holding unit 4 has a first end provided with a resting portion 432 abutting one of the two extension walls 421 of the respective holding member 42, a second end provided with a locking portion 433 locked onto the support rod 41 and a mediate portion provided with a pivot portion 431 pivotally mounted on the bottom of the respective holding member 42. The pivot portion 431 of each of the two torsion springs 43 is located between the resting portion 432 and the locking portion 433.

In such a manner, when the neck of the saxophone 100 is placed between the two holding members 42 of the holding unit 4, the two holding members 42 of the holding unit 4 are pivoted and moved toward each other by the weight of the saxophone 100 to reach the holding position as shown in FIG. 3, and the resting portion 432 and the locking portion 433 of each of the two torsion springs 43 are moved toward each other to compress each of the two torsion springs 43 so as to store a restoring force. On the contrary, when the neck of the saxophone 100 is detached from the two holding members 42 of the holding unit 4, the resting portion 432 and the locking portion 433 of each of the two torsion springs 43 are moved outwardly to space from each other by the restoring force of each of the two torsion springs 43, and the two holding members 42 of the holding unit 4 are pivoted to space from each other by the restoring force of each of the two torsion springs 43 to reach the expanding position as shown in FIG. 2, so that the neck of the saxophone 100 can be easily removed from the two holding members 42 of the holding unit 4.

Figure 4:
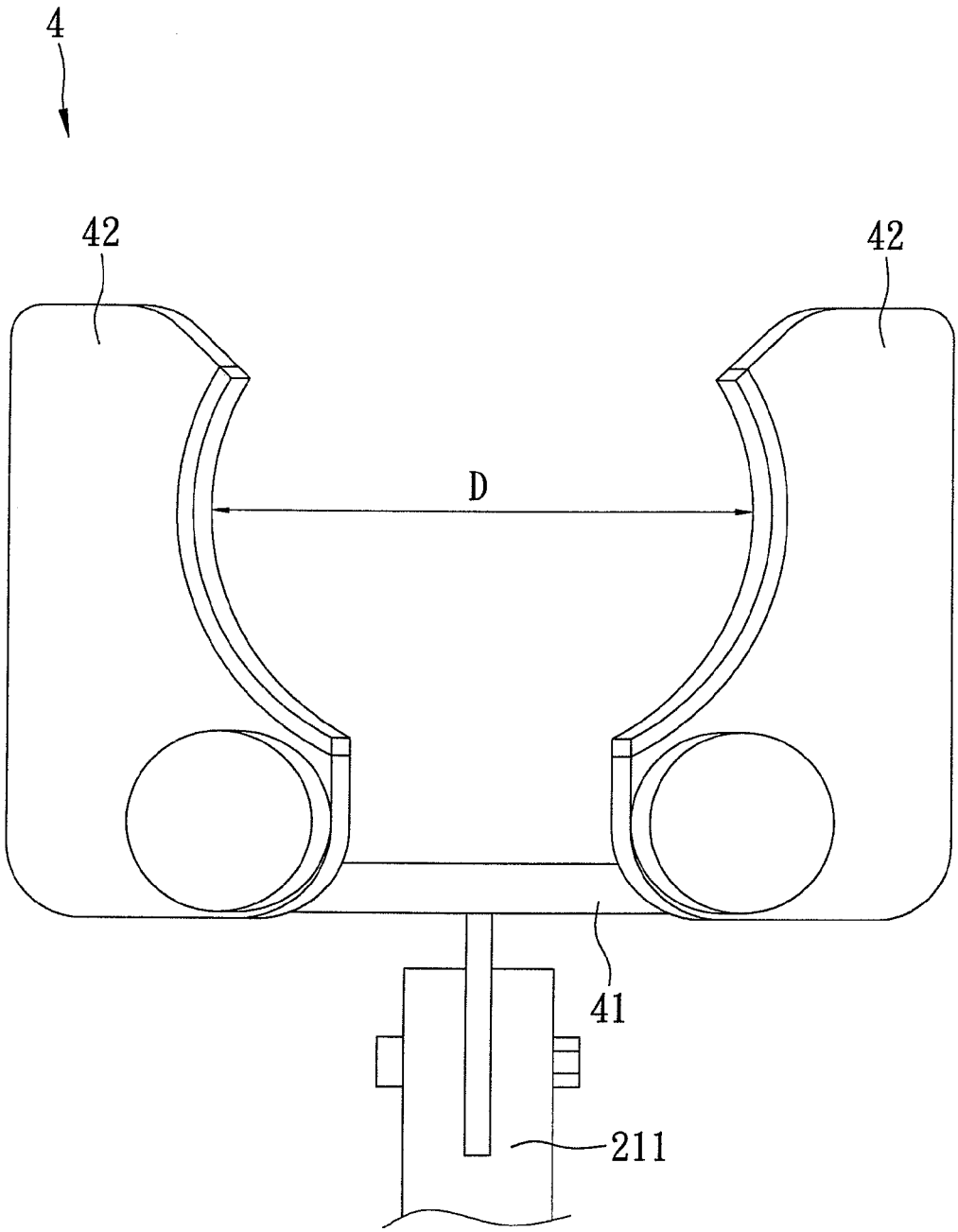
FIG. 4 is a partially top view of the wind instrument stand as shown in FIG. 1.
Figure 5:
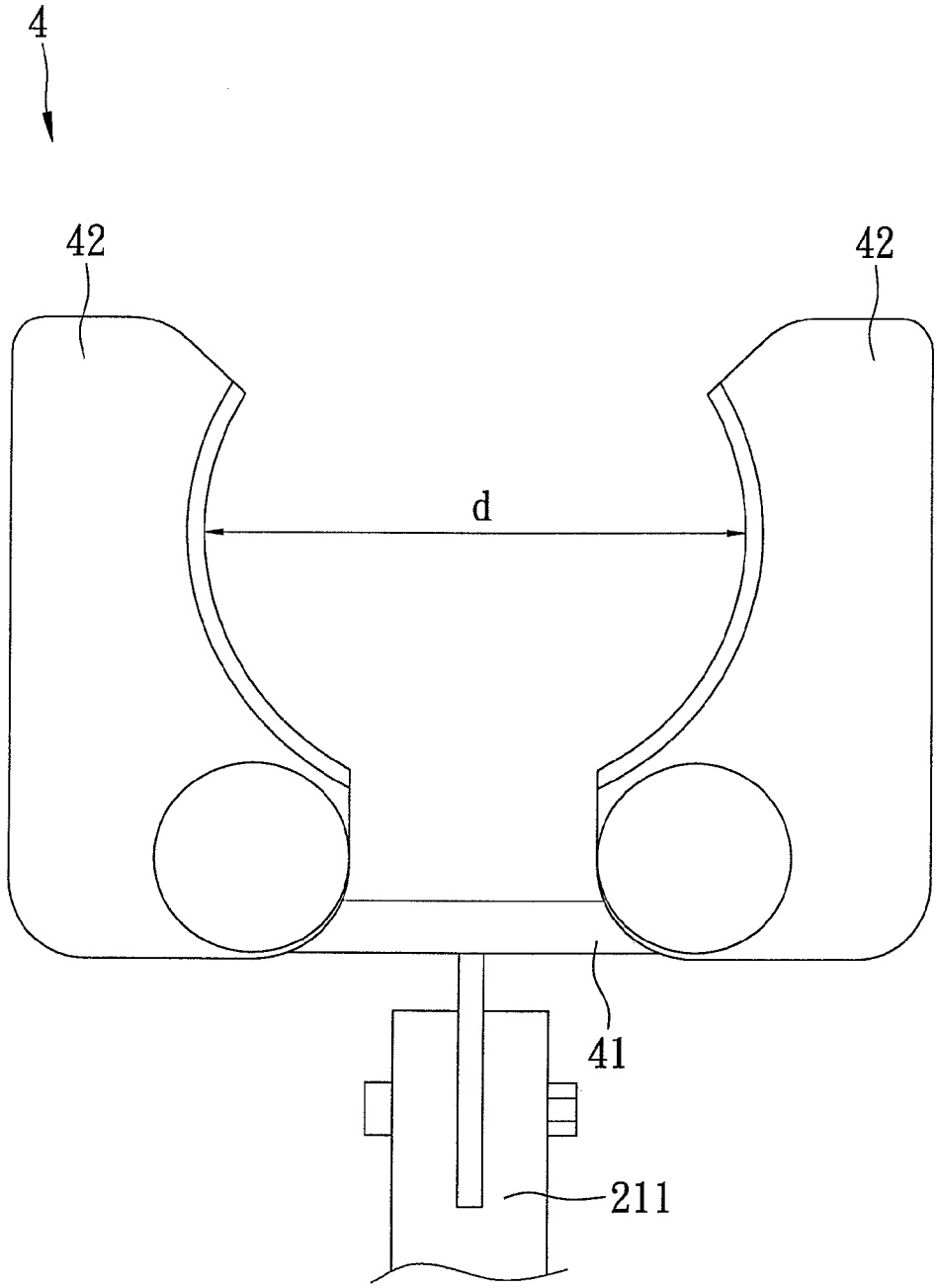
FIG. 5 is a schematic operational view of the wind instrument stand as shown in FIG. 4.

As shown in FIGS. 4 and 5, the two holding members 42 of the holding unit 4 are pivoted to space from each other at the expanding position and are pivoted and moved toward each other at the holding position, so that the distance "D" between the two holding members 42 of the holding unit 4 at the expanding position is greater than the distance "d" between the two holding members 42 of the holding unit 4 at the holding position.

Figure 6:
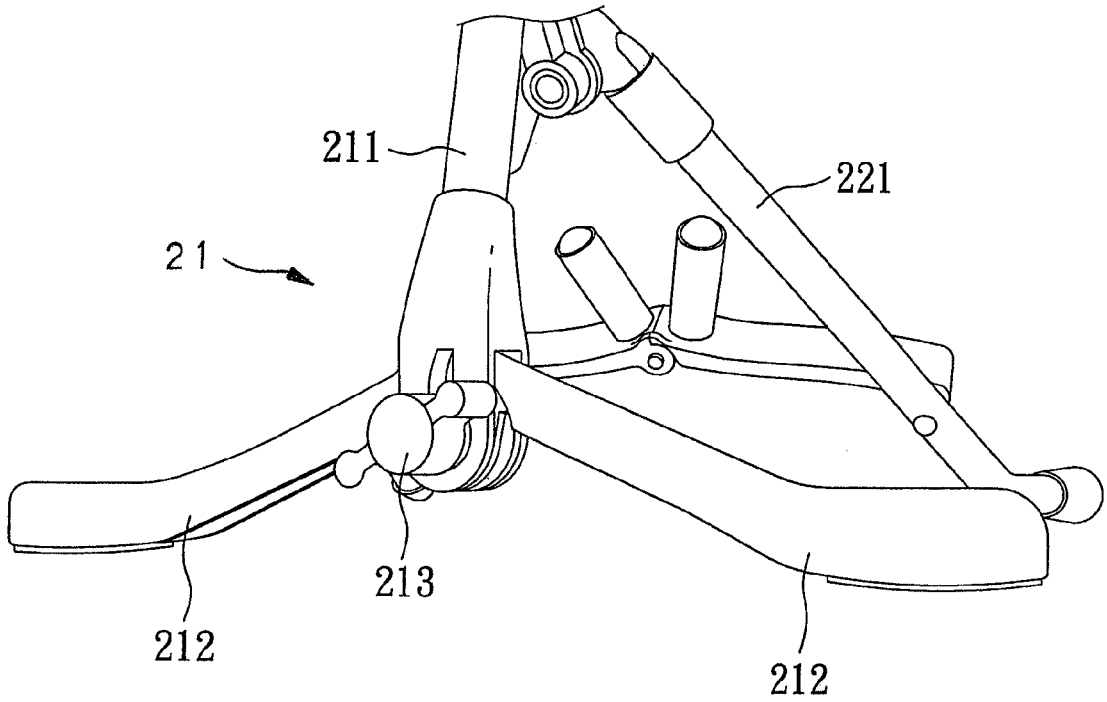
FIG. 6 is a locally enlarged view of the wind instrument stand as shown in FIG. 1.

As shown in FIG. 6, the front support frame 21 of the base 2 further includes a fastening knob 213 rotatably mounted on the bottom of the main body 211 to tighten or loosen the two front legs 212 to or from the main body 211 by rotation of the fastening knob 213 relative to the main body 211.

Figure 7:
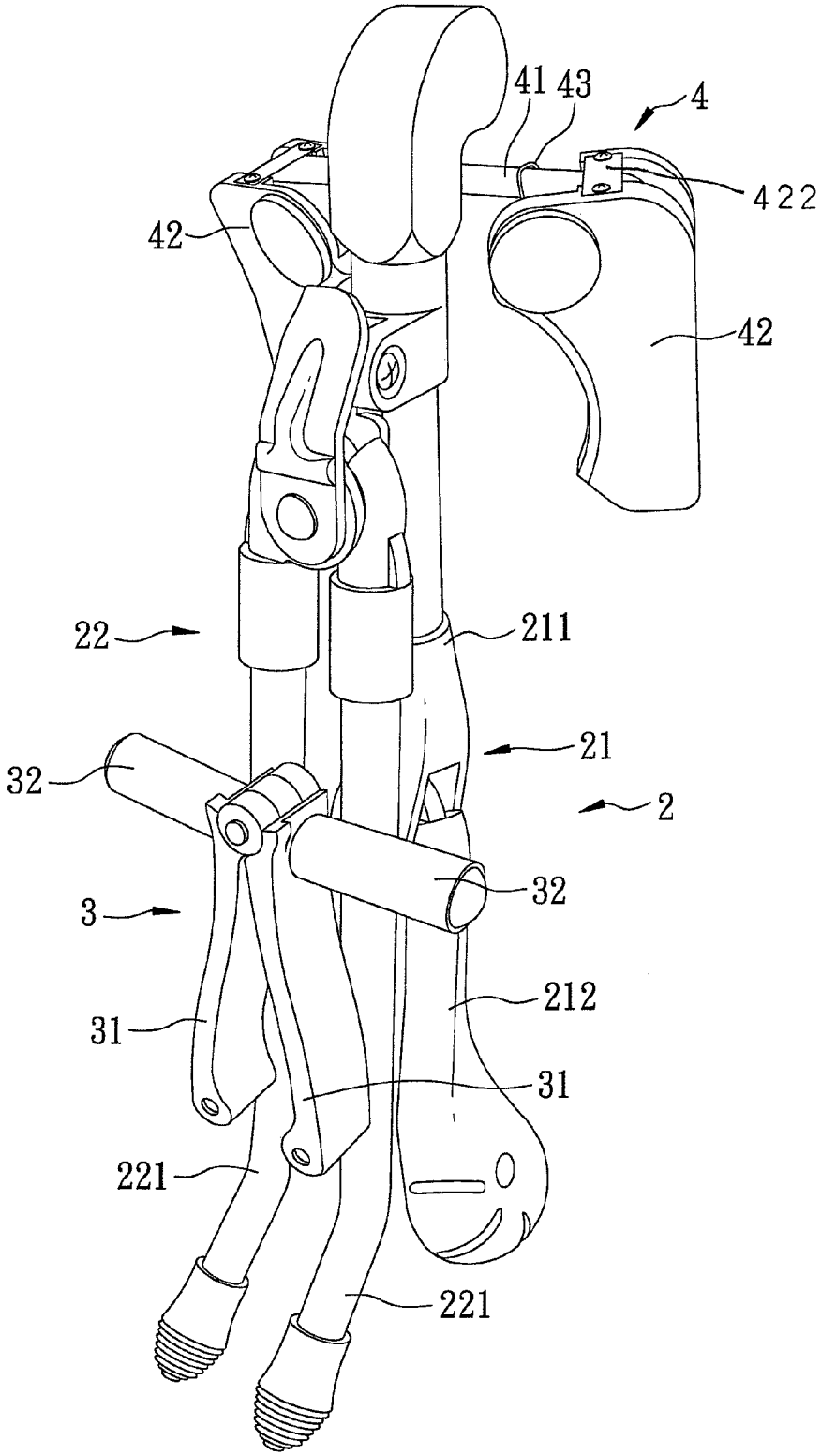
FIG. 7 is a folded view of the wind instrument stand as shown in FIG. 1.

As shown in FIG. 7, the holding unit 4 is pivoted rearward relative to the front support frame 21 of the base 2, the two front legs 212 of the front support frame 21 are moved to approach each other, the two rear legs 221 of the rear support frame 22 are moved to approach each other, the two support members 31 of the support unit 3 are moved to approach each other, and the rear support frame 22 is moved to approach the front support frame 21, so that the wind instrument stand is folded to have a smaller volume to facilitate a user carrying and storing the wind instrument stand.

Figure 8:
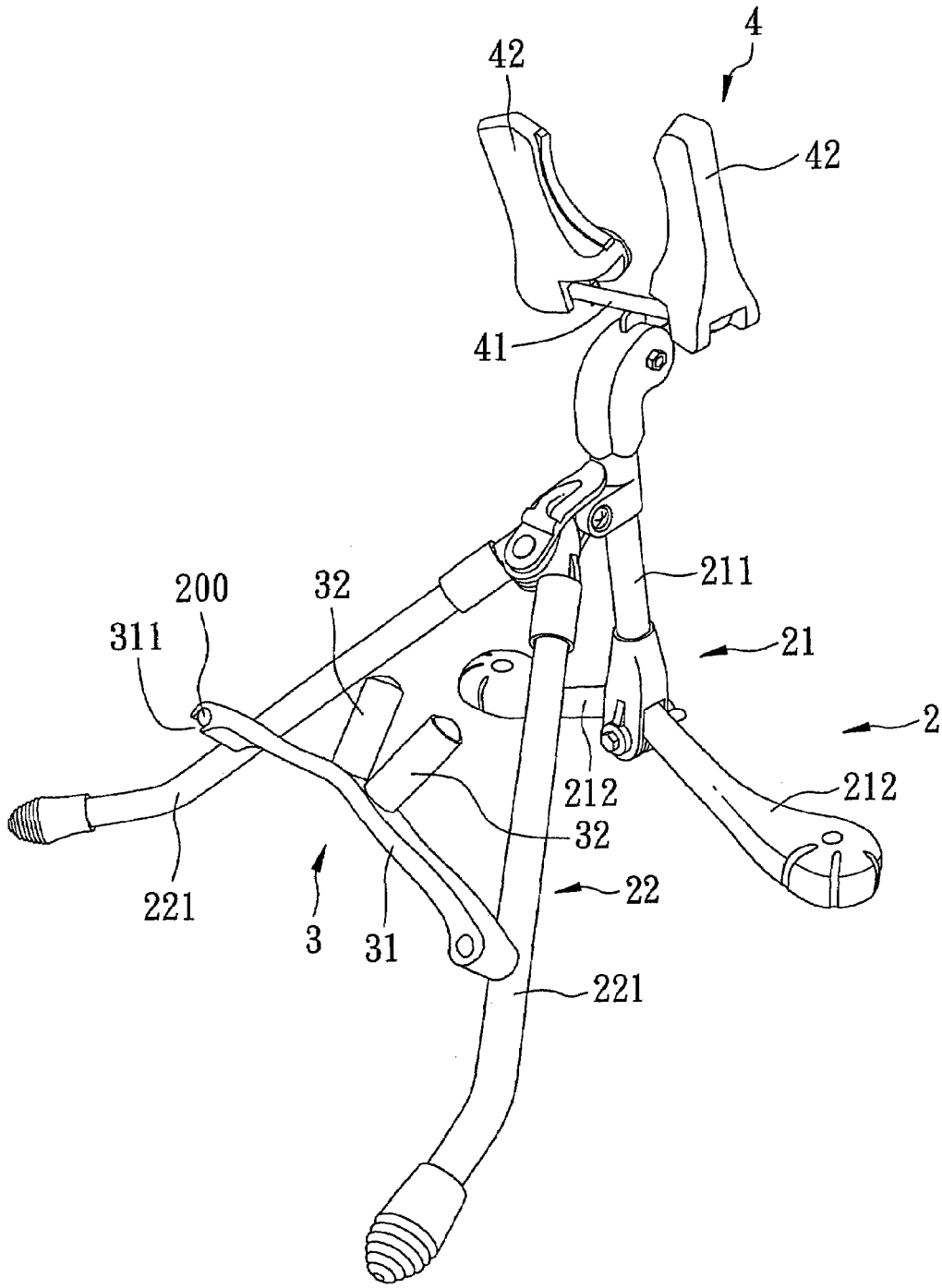
FIG. 8 is a perspective view of a wind instrument stand in accordance with another preferred embodiment of the present invention.
Figure 9:
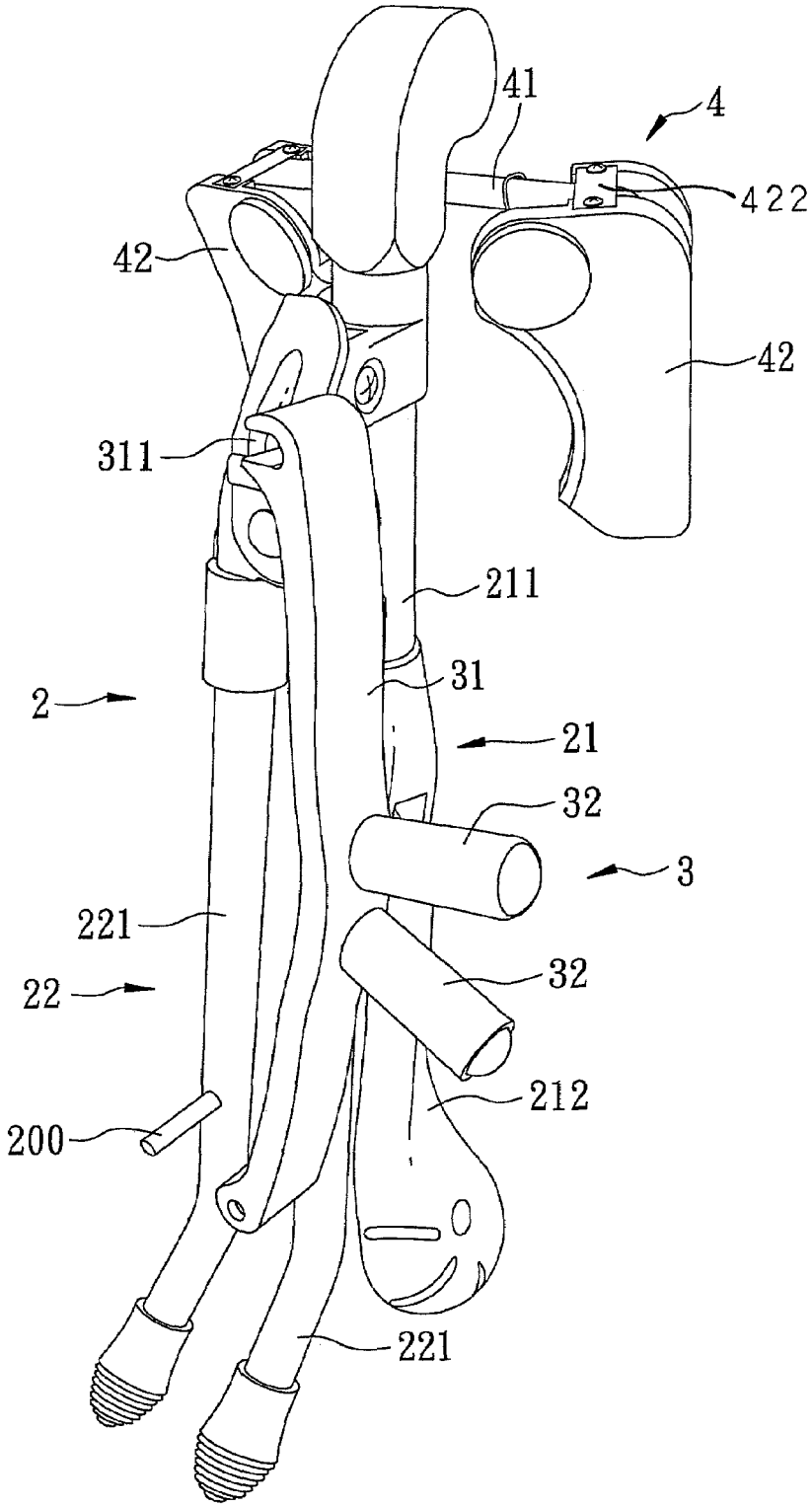
FIG. 9 is a folded view of the wind instrument stand as shown in FIG. 8.

As shown in FIGS. 8 and 9, the support unit 3 includes a support member 31 having a first end pivotally connected with one of the two rear legs 221 of the rear support frame 22 and a second end detachably mounted on the other one of the two rear legs 221 of the rear support frame 22 by a limit pin 200, and two support posts 32 mounted on the support member 31. The second end of the support member 31 is provided with an opening 311 detachably mounted on the limit pin 200.

Figure 10:
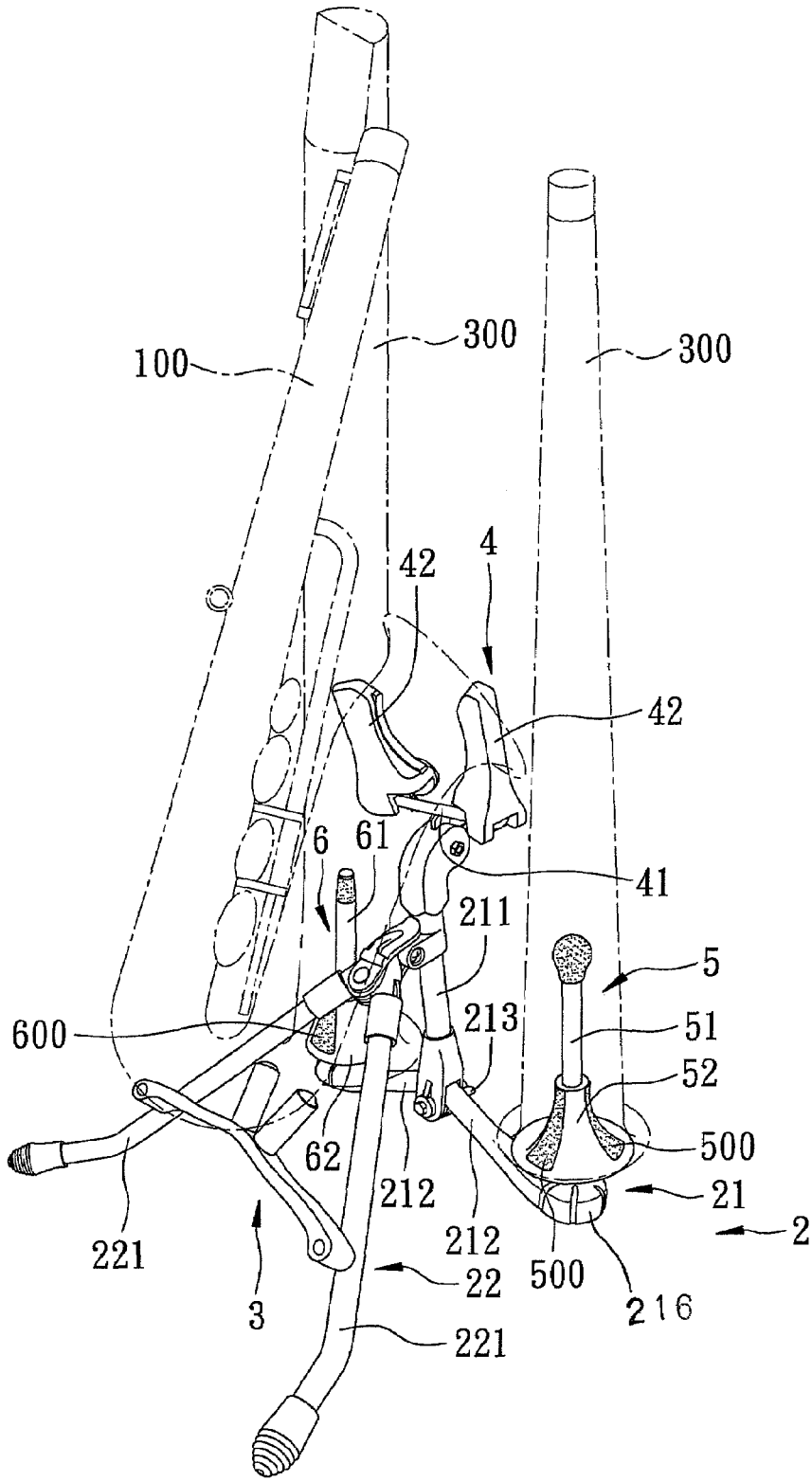
FIG. 10 is a perspective view of a wind instrument stand in accordance with another preferred embodiment of the present invention.
Figure 11:
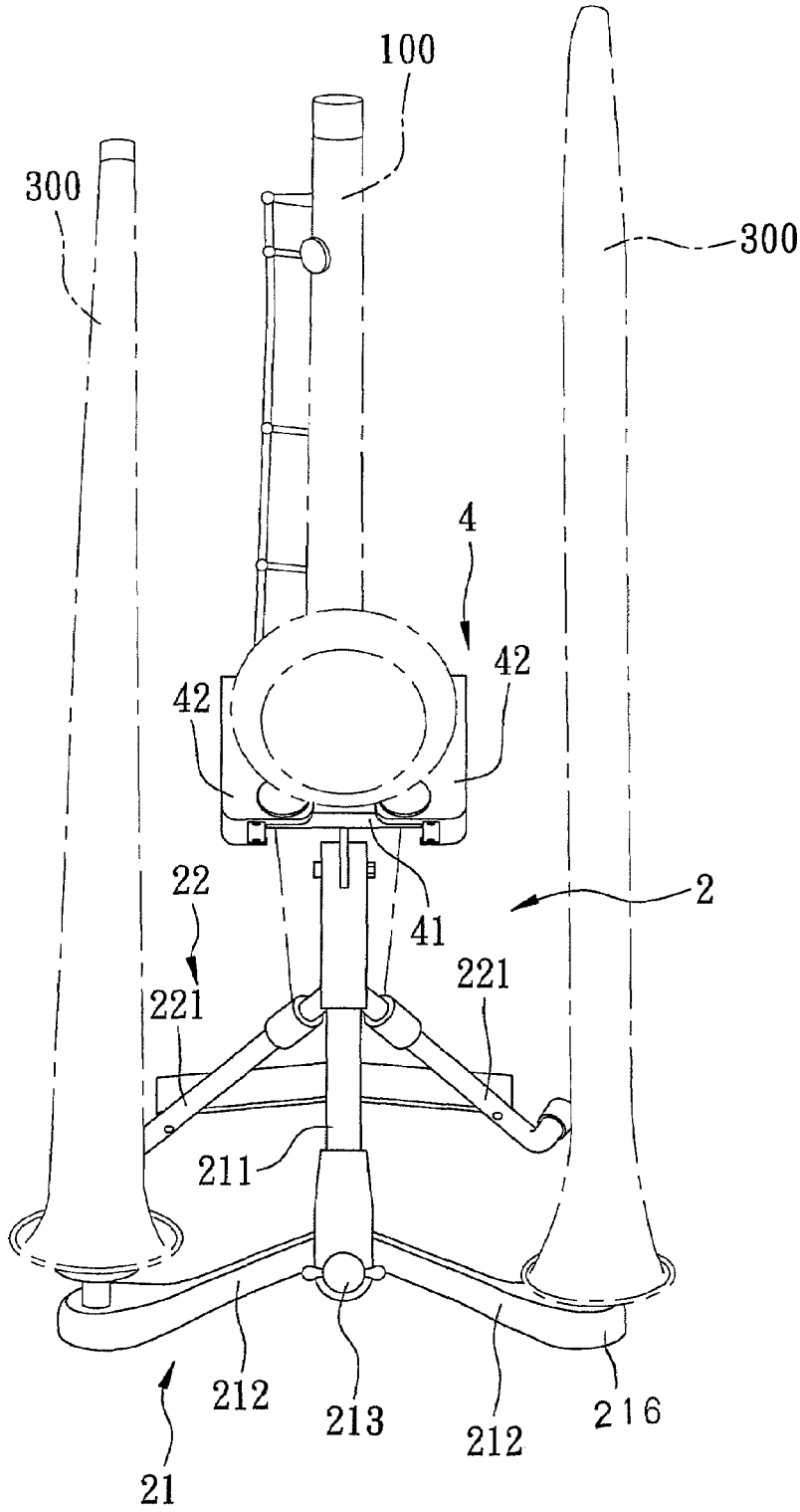
FIG. 11 is a front view of the wind instrument stand as shown in FIG. 10.
Figure 12:
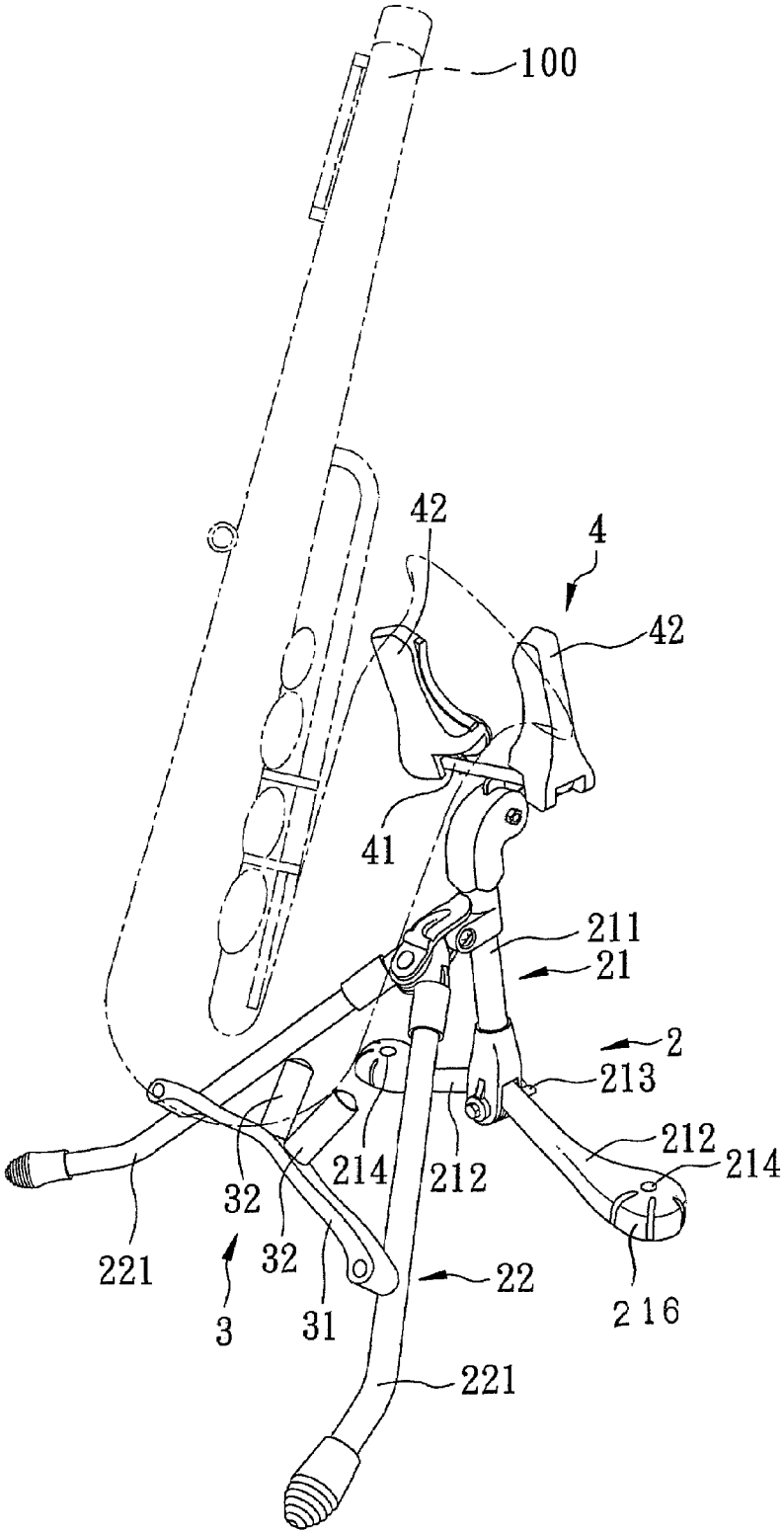
FIG. 12 is a partially perspective view of the wind instrument stand as shown in FIG. 10.

Referring to FIGS. 10-12, the wind instrument stand further comprises at least one first pole unit 5 and at least one second pole unit 6 mounted on the two front legs 212 of the front support frame 21 respectively to support two clarinets 300 respectively. The distal end 216 of each of the two front legs 212 has a surface provided with at least one mounting hole 214 for mounting the first pole unit 5 or the second pole unit 6.

Figure 13:
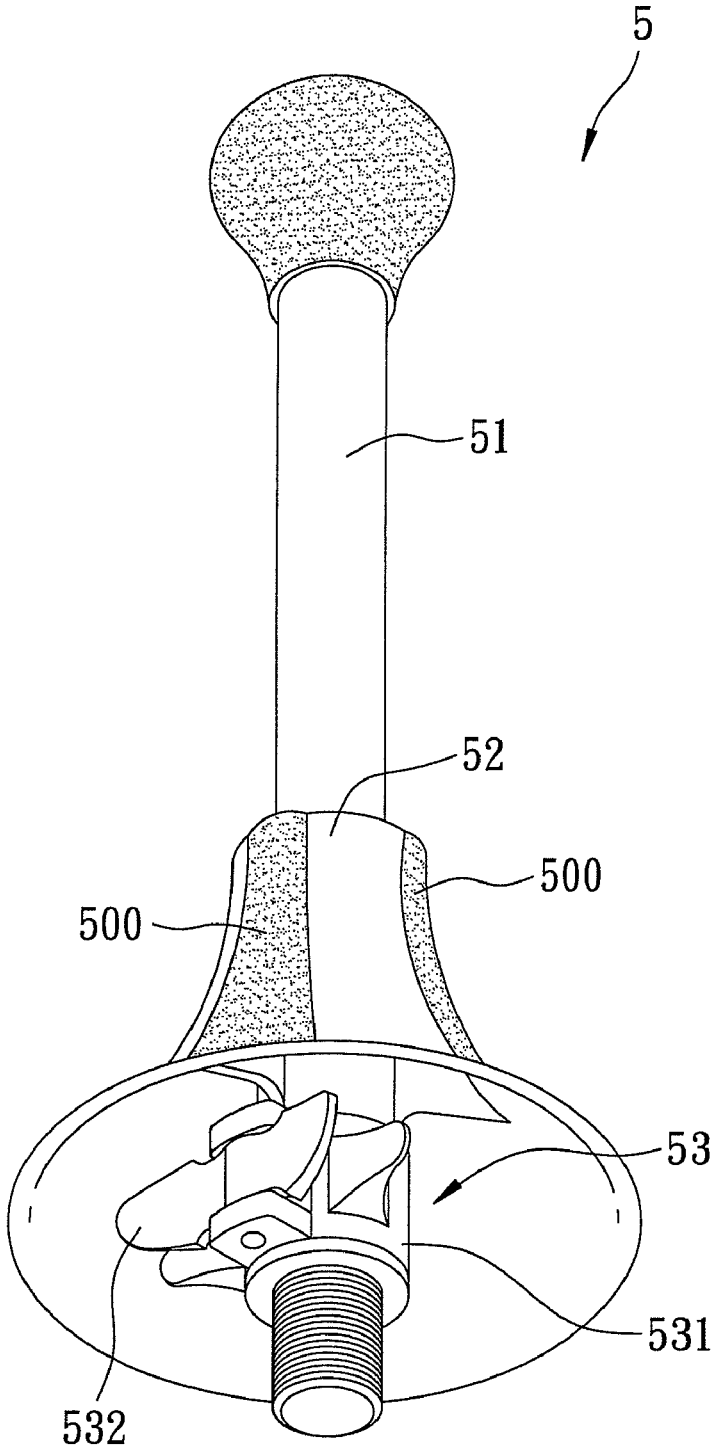
FIG. 13 is a perspective view of a first pole unit of the wind instrument stand as shown in FIG. 10.
Figure 14:
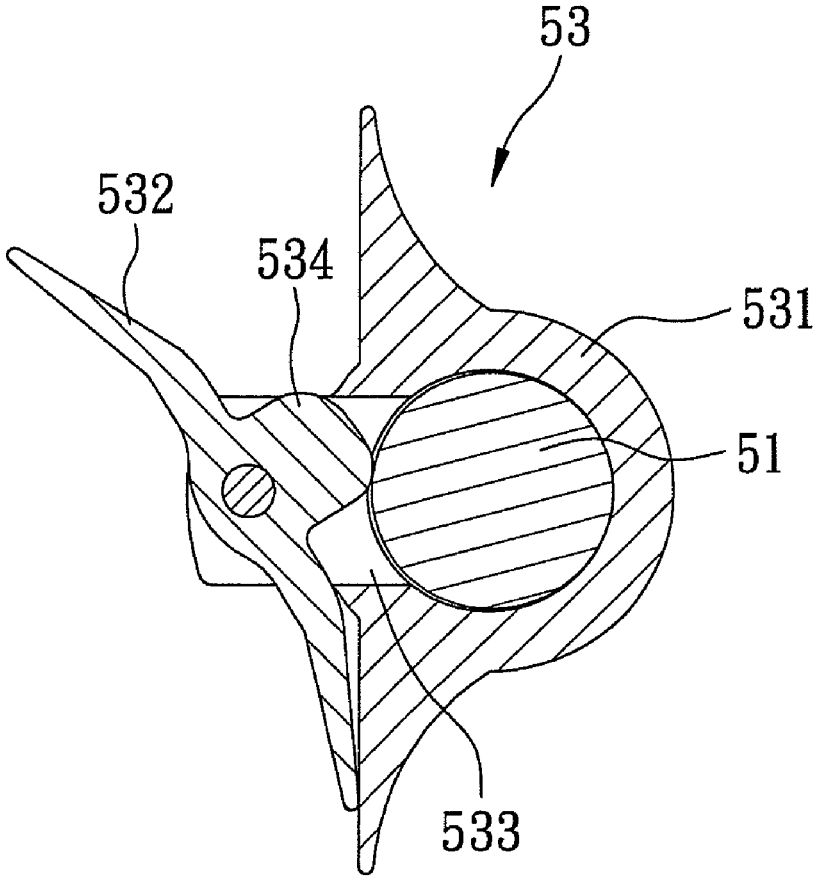
FIG. 14 is a top cross-sectional view of the first pole unit of the wind instrument stand as shown in FIG. 13.
Figure 15:
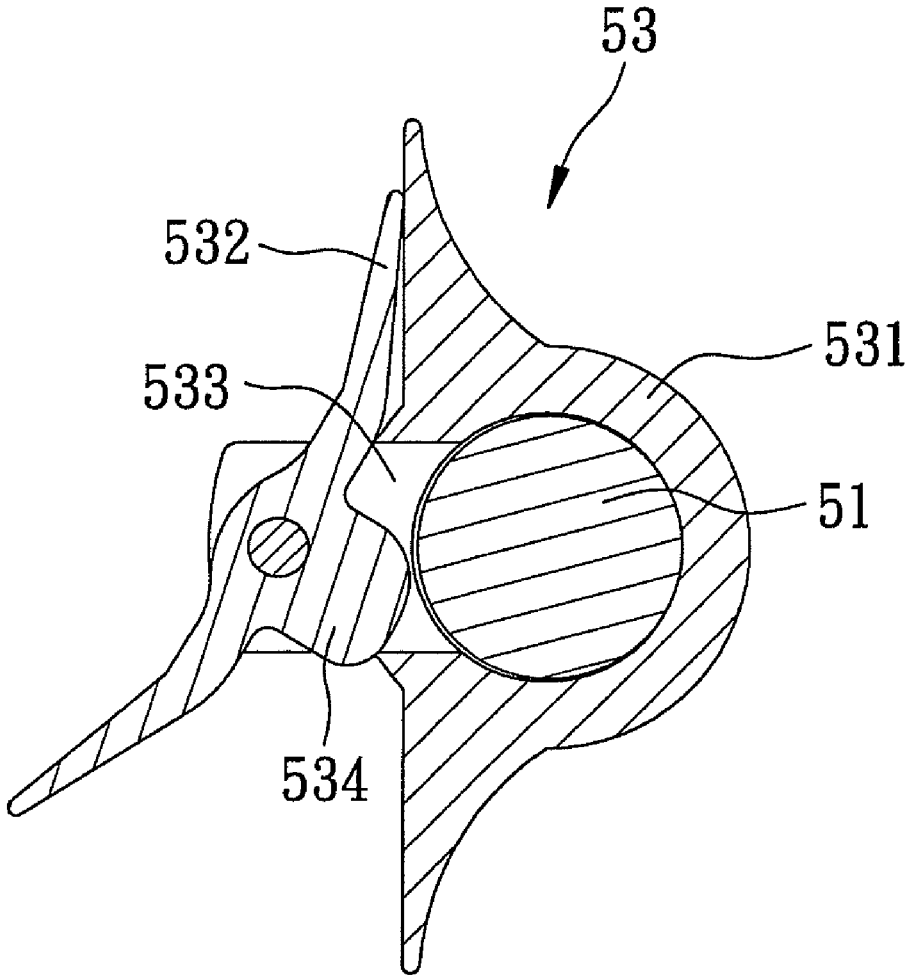
FIG. 15 is a schematic operational view of the first pole unit of the wind instrument stand as shown in FIG. 14.

As shown in FIGS. 13-15, the first pole unit 5 includes a first pole 51 mounted on and extending upward from the distal end 216 of one of the two front legs 212 for mounting the respective clarinet 300, a first bell 52 adjustably and movably mounted on the first pole 51 and having a surface provided with a plurality of soft pads 500 for mounting an opened end of the respective clarinet 300, and a quick release 53 mounted on a bottom of the first bell 52 and releasably locked onto the first pole 51 to adjustably lock the first bell 52 onto the first pole 51. The first pole 51 of the first pole unit 5 is perpendicular to the distal end 216 of each of the two front legs 212. The quick release 53 of the first pole unit 5 includes a fixing seat 531 mounted on the bottom of the first bell 52 and movably mounted on the first pole 51 and a drive handle 532 pivotally mounted on the fixing seat 531 and having a side provided with an eccentrically arranged pressing block (or cam) 534 that is movable to press the first pole 51 so as to releasably lock the fixing seat 531 onto the first pole 51. The fixing seat 531 of the quick release 53 has a side provided with a receiving space 533 in which the pressing block 534 of the drive handle 532 is movable. Thus, the drive handle 532 of the quick release 53 is movable relative to the fixing seat 531 of the quick release 53 between a first position as shown in FIG. 14 where the pressing block 534 of the drive handle 532 is movable to press the first pole 51 so as to lock the fixing seat 531 of the quick release 53 onto the first pole 51 and a second position as shown in FIG. 15 where the pressing block 534 of the drive handle 532 is movable to detach from the first pole 51 so as to unlock the fixing seat 531 of the quick release 53 from the first pole 51.

Figure 16:
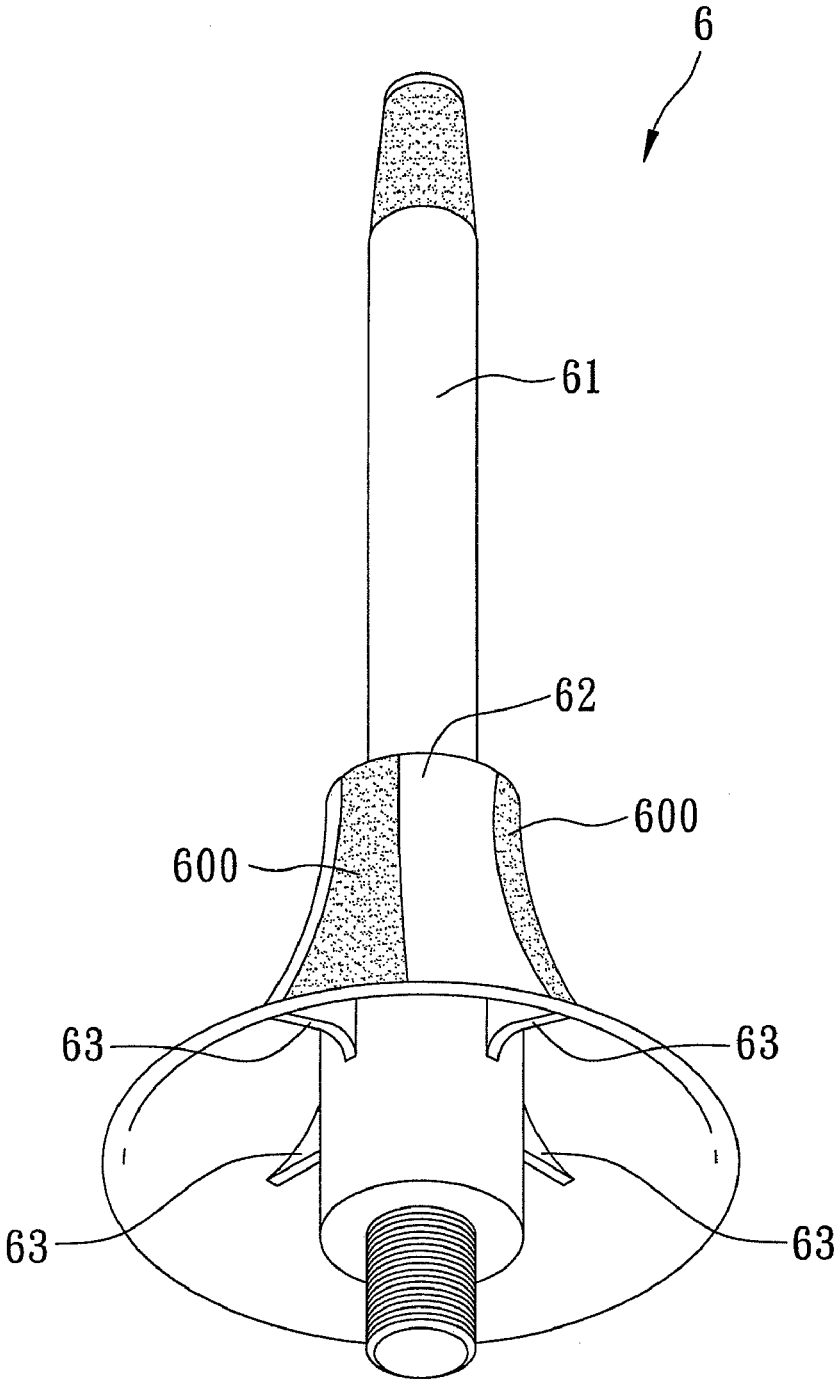
FIG. 16 is a perspective view of a second pole unit of the wind instrument stand as shown in FIG. 10.
Figure 17:
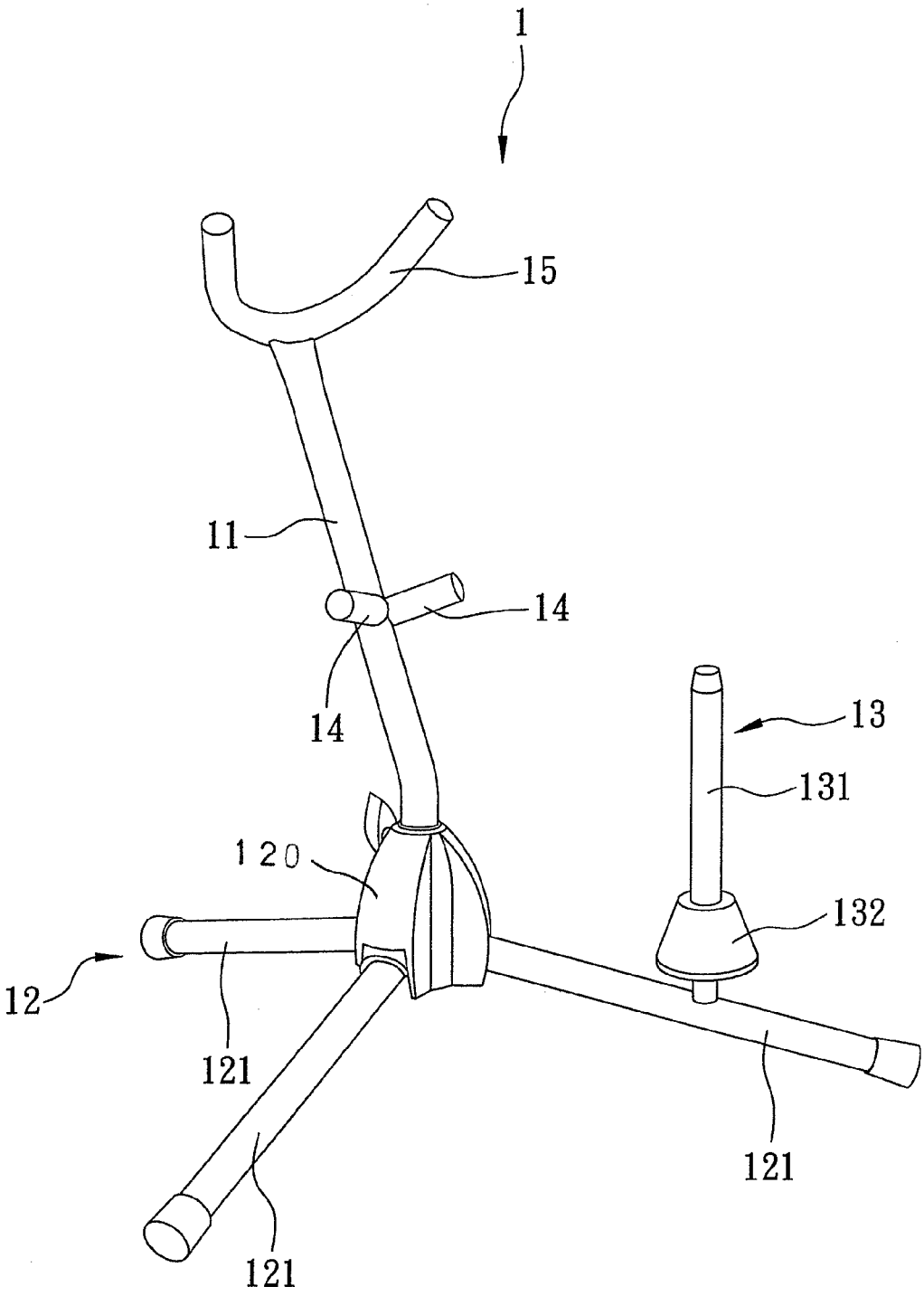
FIG. 17 PRIOR ART
FIG. 17 is a perspective view of a conventional wind instrument stand in accordance with the prior art.

As shown in FIG. 16, the second pole unit 6 includes a second pole 61 mounted on and extending upward from the distal end 216 of one of the two front legs 212 of the front support frame 21 for mounting the respective clarinet 300, a second bell 62 adjustably and movably mounted on the second pole 61 and having a surface provided with a plurality of soft pads 600 for mounting an opened end of the respective clarinet 300, and a plurality of reinforcing strips 63 mounted between the second pole 61 and the second bell 62. The second pole 61 of the second pole unit 6 is perpendicular to the distal end 216 of each of the two front legs 212 of the front support frame 21.

Accordingly, when the neck of the saxophone 100 is placed between the two holding members 42 of the holding unit 4, the two holding members 42 of the holding unit 4 are pivoted and moved toward each other by the weight of the saxophone 100 to reach the holding position so as to hold and clamp the neck of the saxophone 100, so that the neck of the saxophone 100 is clamped between the two holding members 42 of the holding unit 4 exactly and stably so as to prevent the saxophone 100 from being detached from the two holding members 42 of the holding unit 4 due to an accidental vibration or hit. In addition, when the neck of the saxophone 100 is detached from the two holding members 42 of the holding unit 4, the two holding members 42 of the holding unit 4 are pivoted to space from each other by the restoring force of each of the two torsion springs 43 to reach the expanding position, so that the neck of the saxophone 100 can be easily removed from the two holding members 42 of the holding unit 4. Further, each of the two front legs 212 of the front support frame 21 has a distal end 216 that is arranged at a horizontal state, so that each of the first pole unit 5 and the second pole unit 6 is vertical to the ground so as to support the clarinets 300 smoothly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A wind instrument stand, comprising:

a base including:

a front support frame;

a rear support frame pivotally connected with the front support frame;

a holding unit mounted on the front support frame of the base and including:

a support rod rotatably mounted on a top of the front support frame;

two holding members pivotally mounted on two opposite ends of the support rod respectively;

two torsion springs each biased between the support rod and a respective one of the two holding members;

wherein the front support frame of the base includes:

an upright main body;

two front legs each pivotally connected with a bottom of the main body;

each of the two front legs of the front support frame has a distal end that is arranged at a horizontal state;

the wind instrument stand further comprises:

at least one pole unit mounted on one of the two front legs of the front support frame.

2. The wind instrument stand of claim 1, wherein the distal end of each of the two front legs has a surface provided with at least one mounting hole for mounting the pole unit.

3. The wind instrument stand of claim 2, wherein the pole unit includes:

a pole mounted on and extending upward from the distal end of one of the two front legs;

a bell adjustably and movably mounted on the pole.

4. The wind instrument stand of claim 3, wherein the pole unit further includes:

a quick release mounted on a bottom of the bell and releasably locked onto the pole to adjustably lock the bell onto the pole.

5. The wind instrument stand of claim 4, wherein the quick release of the pole unit includes:

a fixing seat mounted on the bottom of the bell and movably mounted on the pole;

a drive handle pivotally mounted on the fixing seat and having a side provided with an eccentrically arranged pressing block that is movable to press the pole so as to releasably lock the fixing seat onto the pole.

6. The wind instrument stand of claim 5, wherein the fixing seat of the quick release has a side provided with a receiving space in which the pressing block of the drive handle is movable.

7. The wind instrument stand of claim 5, wherein the drive handle of the quick release is movable relative to the fixing seat of the quick release between a first position where the pressing block of the drive handle is movable to press the pole so as to lock the fixing seat of the quick release onto the pole and a second position where the pressing block of the drive handle is movable to detach from the pole so as to unlock the fixing seat of the quick release from the pole.

8. The wind instrument stand of claim 3, wherein the bell of the pole unit has a surface provided with a plurality of soft pads.

9. The wind instrument stand of claim 3, wherein the pole of the first pole unit is perpendicular to the distal end of each of the two front legs.

10. The wind instrument stand of claim 3, wherein the pole unit further includes:

a plurality of reinforcing strips mounted between the pole and the bell.

11. The wind instrument stand of claim 1, wherein the rear support frame of the base includes two rear legs each pivotally connected with a top of the main body of the front support frame.

12. The wind instrument stand of claim 11, wherein the rear support frame of the base extends rearward from a top of the front support frame;

the rear support frame of the base co-operates with the front support frame of the base to form a standing state;

each of the two front legs of the front support frame extends outward from the bottom of the main body;

each of the two rear legs of the rear support frame extends rearward from the top of the main body of the front support frame;

the two rear legs of the rear support frame co-operate with the two front legs of the front support frame to form a standing state.

13. A wind instrument stand, comprising:

a base including:

a front support frame;

a rear support frame pivotally connected with the front support frame;

a holding unit mounted on the front support frame of the base and including:

a support rod rotatable mounted on a top of the front support frame;

two holding members pivotally mounted on two opposite ends of the support rod respectively;

two torsion springs each biased between the support rod and a respective one of the two holding members;

wherein the two holding members of the holding unit are movable relative to the support rod of the holding unit between an expanding position and a holding position;

the two holding members of the holding unit are pivoted to space from each other to reach the expanding position;

the two holding members of the holding unit are pivoted and moved toward each other to reach the holding position;

each of the two torsion springs of the holding unit provides a restoring force to each of the two holding members of the holding unit;

the two holding members of the holding unit are pivoted to space from each other by the restoring force of each of the two torsion springs to reach the expanding position.

14. A wind instrument stand, comprising:

a base including:

a front support frame;

a rear support frame pivotally connected with the front support frame;

a holding unit mounted on the front support frame of the base and including:

a support rod rotatable mounted on a top of the front support frame;

two holding members pivotally mounted on two opposite ends of the support rod respectively;

two torsion springs each biased between the support rod and a respective one of the two holding members;

wherein each of the two holding members of the holding unit has a bottom provided with two downward extending extension walls and a passage defined between the two extension walls;

the holding unit further includes two stop plates mounted between the two extension walls of a respective one of the two holding members and facing the passage of the respective holding member;

each of the two opposite ends of the support rod extends through the passage of a respective one of the two holding members and is limited by a respective one of the two stop plates.

15. The wind instrument stand of claim 14, wherein each of the two torsion springs of the holding unit has a first end provided with a resting portion abutting one of the two extension walls of the respective holding member, a second end provided with a locking portion locked onto the support rod and a mediate portion provided with a pivot portion pivotally mounted on the bottom of the respective holding member.

16. The wind instrument stand of claim 15, wherein when the two holding members of the holding unit are pivoted and moved toward each other, the resting portion and the locking portion of each of the two torsion springs are moved toward each other to compress each of the two torsion springs;

the two holding members of the holding unit are pivoted to space from each other by the restoring force of each of the two torsion springs to reach the expanding position.

17. The wind instrument stand of claim 15, wherein the pivot portion of each of the two torsion springs is located between the resting portion and the locking portion.

* * * * *